US005328157A

United States Patent [19]

Mantey

[11] Patent Number: 5,328,157

[45] Date of Patent: Jul. 12, 1994

[54] METHOD AND AN APPARATUS FOR SEALING TUYERES IN THE SURROUNDING REFRACTORY LINING

[75] Inventor: Paul-Gerhard Mantey, Sulzbach-Rosenberg, Fed. Rep. of Germany

[73] Assignee: Klockner CRA Patent GmbH, Duisburg, Fed. Rep. of Germany

[21] Appl. No.: 47,187

[22] Filed: Apr. 16, 1993

[30] Foreign Application Priority Data

Apr. 21, 1992 [DE] Fed. Rep. of Germany ..... 4213007

[51] Int. Cl.[5] ..... C21C 5/48

[52] U.S. Cl. ..... 266/47; 266/265; 266/268

[58] Field of Search ..... 266/47, 265, 268, 216, 266/217, 270, 271

[56] References Cited

U.S. PATENT DOCUMENTS

| | | | |
|---|---|---|---|
| 4,392,636 | 7/1983 | Clumpner | 266/265 |
| 4,494,735 | 1/1985 | Hershey | 266/265 |
| 4,509,977 | 4/1985 | Geber | 266/265 |
| 4,647,018 | 3/1987 | McDonald | 266/265 |

FOREIGN PATENT DOCUMENTS

4025956A1 2/1992 Fed. Rep. of Germany .

*Primary Examiner*—Scott Kastler

*Attorney, Agent, or Firm*—Nikaido, Marmelstein, Murray & Oram

[57] ABSTRACT

The invention relates to a method and an apparatus for sealing tuyères and feed pipes installed in a refractory vessel lining. Seals known per se, in particular prestressable packings, are installed in the gap between the tuyère or feed pipe and the surrounding refractory material in order to avoid backflow of media.

13 Claims, 2 Drawing Sheets

METHOD AND AN APPARATUS FOR SEALING TUYERES IN THE SURROUNDING REFRACTORY LINING

Figure 1:
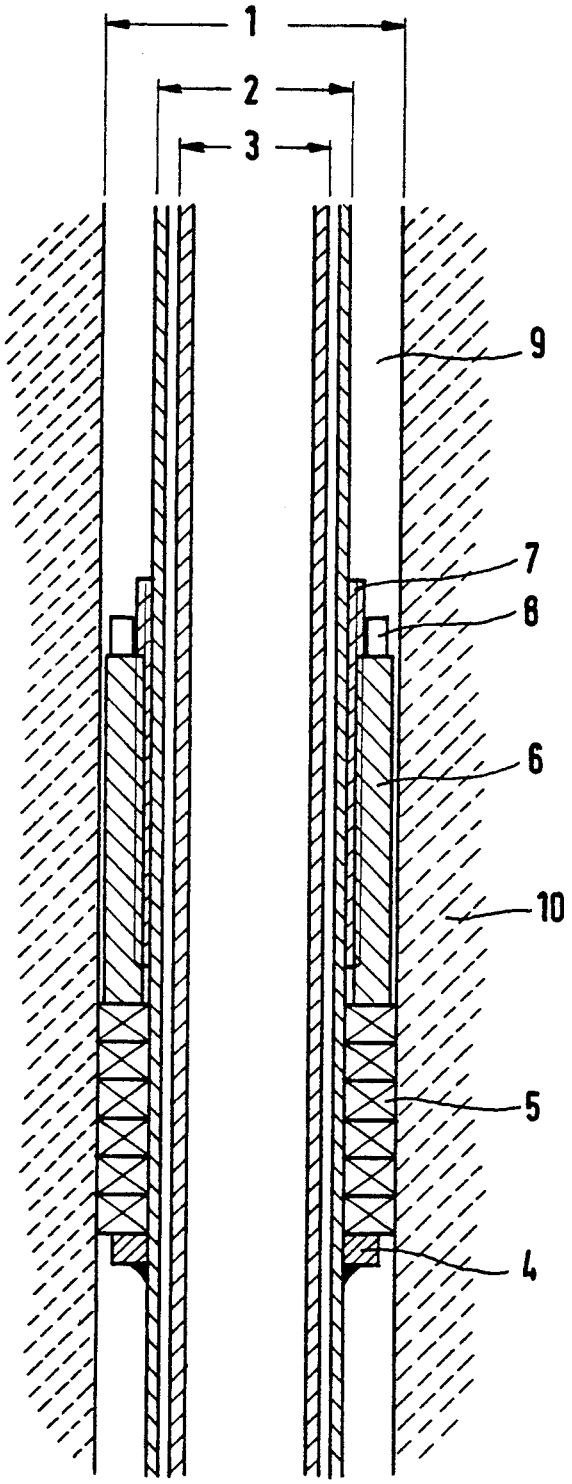

The present invention relates to a method and an apparatus for sealing tuyères and feed pipes for media in metallurgical reaction vessels in which these feed systems are installed in the refractory lining, whereby seals of elastically or plastically deformable materials are installed in the gap between the tuyère or feed pipe and the surrounding refractory material during assembly of these feed systems in order to avoid backflow of media.

In a number of metallurgical methods for metal production and processing, as well as for aftertreatment, i.e. secondary metallurgical processes, one supplies media using feed systems which are firmly installed in the refractory lining of the treatment vessels. For conducting large amounts of gas, as in metallurgical reducing and refining methods, one mainly uses tuyères comprising two or more concentric pipes. By contrast, for the various gas purging methods one preferably uses porous plugs of different dimensions and shapes which have a directional porosity or fine channels for the gas passage, and only simple rinsing gas feed pipes.

A known application of tuyères within the refractory lining below and above the metal bath surface in a metallurgical reaction vessel is steel finery in a bottom-blowing oxygen converter. Here one preferably uses tuyères comprising two concentric pipes, whereby oxygen loaded intermittently with powdered lime is blown into the smelt below the bath surface through the central pipe. To protect this tuyère from burning back prematurely, a tuyère protecting medium, usually gaseous or liquid hydrocarbon, flows through the annular gap between the central pipe and the outer tuyère pipe. The application of methane for protecting oxygen feed tuyères in an iron smelt is stated for the first time in French patent no. 14 50 718; it describes a steel refining test with a copper pipe tuyère comprising two concentric pipes in a 120 kg laboratory converter. The methane rate is 21.25% based on the amount of oxygen.

With the development of the OBM process at the Eisenwerk-Gesellschaft Maximilianshütte mbH as of 1968 and the resulting combined blowing KMS process, this manner of steelmaking was introduced worldwide. The application of oxygen feed tuyères below and above the bath surface is described for instance in British patent no. 20 11 477 and European patent no. 00 30 360.

A known method for smelting reduction of iron ore according to European patent no. 02 36 802 likewise uses underbath tuyères comprising two concentric pipes for introducing fuel, ore and oxygenous gases. To protect the tuyères from burning back prematurely they are subjected in the annular gap to gaseous or liquid hydrocarbons, mainly methane, natural gas, propane or light fuel oil.

The expert world has known for some time that part of the tuyère protecting medium is lost for direct tuyère protection and distributed in uncontrolled fashion within the lining. It has been proven by measurements on a steelmaking converter, among other things, that a gas pressure of up to over 3 bars builds up behind the relatively thick bottom lining of about 1 meter in which the tuyères of this converter are installed, and that the backward flowing gas is the tuyère protecting medium used, in this case propane. A rough determination of the amount of vagrant gas also yielded values of about 25% to a maximum of 50% based on the amount of tuyère protecting medium supplied. This relatively high proportion is lost for its actual purpose of tuyère protection.

Processes for disposing of contaminated and toxic substances in an iron bath have also become known recently in which a backflow of these hazardous media, which are supplied to the smelt through underbath tuyères, could be dangerous. U.S. Pat. No. 4,602,574 describes such a process for example.

These losses of backward flowing or vagrant tuyère media are obviously undesirable. In addition to the strictly economic disadvantages of the portions of tuyère medium escaping unused, there are other disturbing effects such as the flame formation at the various vessel openings, or leaks that lead to an unfavorable evolution of heat at these points. Carbon deposits from cracked hydrocarbons have also been observed in the lining which in turn cause reduction processes in the brick material and finally shorten the durability of the refractories when light fuel oil is used for tuyère protection there is additionally a disturbing development of odor due to the backward flowing portion of this tuyère protecting medium, and in processes for disposing of hazardous substances it is especially important to avoid tuyère media escaping in uncontrolled fashion.

A number of developments have of course been performed in order to reduce the losses of tuyère protecting medium, e.g. encasing the gas feed systems in sheet metal in the refractory brickwork, providing labyrinth sealing systems, various putties and sealing pastes between tuyère pipe and refractory material, enameling the outer tuyère pipes, and similar measures. Up to now, however, these attempts have not led to a convincing result.

It is also known from U.S. Pat. No. 4,509,977 and German print no. 40 25 956 A1 to avoid backflow of media by installing seals in the gap between the tuyère or feed pipe and the surrounding refractory material during assembly of these media feed systems. These seals are made of elastically or plastically deformable materials. However, the sealing effect cannot be maintained for long operating times here since the sealing material shrinks.

The relatively new European patent application no. 03 56 943 relates to a wear-resistant tuyère in the lining of a metallurgical vessel and is characterized by the fact that a layer of less thermoconducting material than the refractory lining is applied to the outer surface of the tuyère pipe. An intermediate layer can also be used to compensate the different thermal expansions of the tuyère pipe metal and the applied insulating layer. This method increased durability from 54 to 60 smelts.

By comparison, the rates of wear of KMS converter bottom tuyères are about 1 millimeter per batch at steel tapping temperatures of 1700° C., which is equivalent to a durability of about 800 batches.

The present invention is based on the problem of designing a method and an apparatus that permit as little medium as possible to escape in uncontrolled fashion from the tuyères and feed pipes installed in the refractory linings of metallurgical reaction vessels, thereby being lost for its application and also causing undesirable side-effects. A substantial waste is the vagrant tuyère protecting medium lost for tuyère protection that is chiefly found behind the lining or distributed within the lining. It is consequently the objective of the inventive method and the inventive apparatus to avoid the losses of tuyère media or reduce them to a minimum and thus simultaneously improve the durability of the tuyères. It is a further objective of the invention to avoid, or at least clearly reduce, the carbon deposits in the refractory lining arising from the vagrant tuyère protecting medium in order to suppress reduction processes in the refractory material and thus improve the durability of the lining.

This problem is solved for the inventive method by the characterizing features of claim 1. Preferred embodiments of the inventive method are stated in claims 2 to 8. It is solved for the inventive apparatus by the characterizing features of claim 9. Preferred embodiments of the inventive apparatus are stated in claims 10 to 12.

It was originally assumed that the media from the tuyères or other feed pipes that are distributed in uncontrolled fashion flow chiefly through the porous refractory material surrounding these feed systems and thus pass behind the refractory lining where they can be detected. Experts were also of the opinion that if the known sealing measures are applied to the tuyères, e.g. refractory sealing compounds shaken in or the outer tuyère pipes enameled, or methods are used as described in the aforesaid European patent application no. 03 56 943, only the amount of gas that can flow through the refractory material due to its gas permeability escapes in uncontrolled fashion. This view was refuted by the installation of seals as in U.S. Pat. No. 4,509,977 and German print no. 40 25 956 A1, which results in an improved sealing effect at least for a short time.

In an unforeseeable way and contrary to expert opinions, the inventive method shows a new way of avoiding the undesirable vagrant gases and/or liquids their consequences in metallurgical vessels. For example, without application of the inventive method a pressure of about 2.5 bars arises in a KMS steelmaking converter behind the bottom lining directly after the oxygen tuyères start being used, i.e. with the onset of refining. As gas analyses have confirmed, this pressure builds up from backward flowing tuyère protecting medium. After application of the inventive method no pressure buildup can be detected any longer behind the lining under otherwise identical conditions.

Seals are installed in the gap between the metal pipe and the surrounding refractory material during assembly of the tuyères from two or more concentric pipes or the simple gas feed pipes. These seals may be made of permanently elastic materials that retain their elasticity at the given temperature in the vicinity of the tuyères. For example, special types of rubber, mainly silicone rubber, permanently elastic silicone putty and similar materials, have proven useful. These sealing materials can be provided in the gap between the feed system and the surrounding refractory material during assembly or thereafter.

Seals or sealing systems can be used that have a prestress, i.e. are under a preliminary pressure. This preliminary pressure can be built up by the sealing material itself, e.g. materials are suitable that expand after being installed due to special properties. For example one can use plastics with various bases that consist of two or more components and expand after the components are mixed. One can also use inorganic materials such as refractories, which are ground or in the form of fibrous material, preferably mixtures thereof, with a proportion of expanding substances, e.g. swelling clay or vermiculite.

According to the invention the seal is constantly held under an adjustable pressure by suitable pneumatic, hydraulic and/or mechanical means.

An advantageous form of the inventive method is thus to use prestressable seals, in particular packings. One basically provides one or more layers of a packing cord on a supporting ring firmly connected with the outer pipe of the medium feed system, and prestresses this packing after the tuyère or at least the outer tuyère pipe is installed. The packing can be prestressed for example by mechanical actuators, such as threaded sleeves or screws, directly or using a transition piece. According to the invention this pre-stressing can be adjusted with a mechanical actuator a single time upon assembly of a tuyère, or the packing can additionally be restressed at any time intervals.

It is particularly preferred to pressurize the seals with pneumatic or hydraulic tubular pistons surrounding the tuyère pipe. An optional combination of mechanical, pneumatic and hydraulic means is also possible.

The seal can advantageously be constantly pressurized by a flat spiral spring. According to a further feature of the invention the pressure acting on the seals is held constant or can be controlled to rise or drop in time-dependent fashion. For example it has proven useful to increase the pressure as the working time of the seal increases in order to counteract signs of aging in the seal that can also be temperature-induced. Depending on the sealing material used, however, a reduced pressure can also be used after a certain time. It is also within the scope of the invention to change the pressure acting on the seal evenly or alternatingly between a maximum and a minimum value one or more times or to vary it constantly in accordance with a given time pattern.

Although there are no upward or downward pressure limits for prestressing the seals or packings according to the invention, it has proven useful in practice when applying the inventive method to have a pressure between 5 $kg/cm^2$ and 500 $kg/cm^2$, preferably between 10 $kg/cm^2$ and 50 $kg/cm^2$, act on the sealing systems.

The fitting position of the seal can basically be selected freely both over the length of a tuyère and over the length of a simple gas feed pipe. Since these medium feed means, e.g. oxygen tuyères in a converter bottom, wear continuously during their working time the inventive method prefers a fitting position for the sealing system, preferably the packing, close to the outer, i.e. the cold, side of the lining, at most up to half the tuyère length penetrating the lining.

The seal is installed upon assembly of the medium feed systems. This does not refer solely to new assembly but also to each further assembly after repair, for example of a tuyère. For example it is customary to replace completely or partly worn tuyère pipes by corresponding new tuyères in downtimes during the operating time of a steelmaking converter or a reactor vessel for smelting reduction, both of which have multipipe feed tuyères below the bath surface. During this installation of a new tuyère pipe or usually a complete tuyère it is within the scope of the invention to also change all or part of the packing with its prestressing system.

The above exemplary mentions of medium feed systems such as multipipe tuyères and gas feed pipes refer to pipes and thus to circular cross sections. However, the inventive method is not limited to circular cross sections of medium feed systems. It can be used for any cross-sectional shapes, e.g. rectangular, oval or any polygonal shapes.

The surprising effect of the inventive method is probably due to the fact that a thin annular gap forms between the steel pipe of the tuyère and the refractory material, also when ceramic sealing and shaking compounds or seals are used in the annular gap about the tuyère pipe, due to the large differences in thermal expansion between steel and refractory material, and that parts of the gaseous and/or liquid media supplied by the feed systems flow back within this gap. The observation of an increasing pressure buildup behind the bottom lining of a KMS steelmaking converter as the working time increases speaks for this supposition. The limit of the seal is thus determined according to the inventive method by the gas permeability of the surrounding refractory material, i.e. the amounts of gas straying directly through the refractory material can, as expected, not be substantially reduced by the inventive method.

Refractory material having low gas permeability and high mechanical strength is suitably used in the immediate environment of the tuyères. For example it has proven useful to reduce the gas permeability by using magnesite-carbon bricks, preferably qualities of this type of brick with carbon contents of about 10 to about 20%. It has also proven favorable to additionally impregnate this type of brick with pitch subsequently. The inventive method is of course independent of the quality of the refractory material in the environment of the medium feed systems. The linings of the metallurgical vessels can be made for example of grog from high alumina qualities to corundum and magnesite or magnesite-chromium bricks and dolomite.

For special applications, relatively gastight and high-strength molten cast bricks, e.g. corundum of various qualities and isostatically pressed materials, have proven useful. It is within the scope of the invention to install special shaped bricks or pipes made of this molten cast or isostatically pressed refractory material only about the tuyère pipe as an intermediate layer for the customary refractory lining. The inventive sealing system then acts in the gap between the medium feed means and the largely gastight and high-strength refractory material. For example, pipes made of molten cast or isostatically pressed material prove advantageous for several reasons over the whole fitting length of the tuyère or only in the area of the packing. These pipes have no, or very few, joints over the length of the tuyère, are relatively gastight, have high mechanical strength and thus permit high pressures for prestressing the packing.

A further pipe can be used in addition to the pipes of a multipipe tuyère or a simple feed pipe. This additional pipe is installed according to the above-described method for sealing tuyères in the surrounding refractory lining, and serves to take up the customary medium feed system, e.g. a tuyère, which is sealed by commercial means from the additional pipe outside the metallurgical vessel.

The above-described fundamental structure of a seal and in particular of the prestressable packing, which is preferably used in the inventive method for sealing tuyères and feed pipes for media in metallurgical reaction vessels, will now be supplemented by further details and practice-related empirical values. When "tuyères" are spoken of in the following this will include both the outer tuyère pipe of a two- or multipipe tuyère and a simple feed pipe for purging cones or porous plugs. The pipe information is also applicable analogously to non-circular cross sections.

A tuyère is normally inserted from outside, i.e. from the steel plate jacket of the vessel or the cold side of the refractory material, into the tuyère channel which is drilled or made of refractory shaped bricks. The seal or packing is disposed in the annular gap resulting between the tuyère pipe and the refractory material. This seal lies on one side on a bearing firmly connected with the tuyère pipe, usually a steel ring welded to the tuyère pipe. The packing is mounted in the refractory material close to the cold side, at a depth of approximately 50 mm to 500 mm, preferably 100 mm to 300 mm, away from the sheet steel jacket in the direction of the tip of the tuyère.

According to the invention the seal or packing can be prestressed by a mechanical actuator, e.g. a screw sleeve with an inside thread that engages a matching thread on the tuyère pipe. Using a special wrench one turns this threaded sleeve until the packing has the desired prestress. It is of course irrelevant whether the threaded sleeve is screwed tight from the tip of the tuyère, i.e. the inside of the vessel, or from the outer side. The packing must accordingly only be disposed between the support and the screw sleeve.

A very advantageous improvement of the invention is to install a flat spiral spring with or without an intermediate ring between the packing and the threaded sleeve and to compress or prestress it 1 cm to 10 cm, preferably 2 cm to 5 cm.

In accordance with the packing which is compressed by the mechanical actuator, one can also use a sealing material that expands in time-dependent fashion or swells when heated. Such an expanding sealing material can already be disposed between two stationary bearings upon assembly of the tuyère, or it is introduced after the tuyère has been installed, for example by a pneumatically or electrically driven injector.

A particularly advantageous design of the inventive apparatus is to apply the pressure to the sealing system, in particular a packing, by pneumatically and/or hydraulically driven actuators. For this purpose a pipe-like cylinder can be slidingly disposed on the tuyère pipe, the outer end of the cylinder ending movably in a hydraulic or pneumatic pressure chamber and thus acting on the seal like a die depending on the pressurization in the chamber. A tubular, displaceable transition piece can of course be mounted between this hydraulic pressure cylinder and the actual seal.

For many cases of application in practice it has proven useful in particular to apply a suitably strong flat spiral spring, which is prestressed to the desired degree by screws or other mechanical, adjustable supports so that it can act on the seal over a long spring excursion and approximately with uniform pressure.

A very advantageous application of the inventive method arises for disposal of hazardous waste, in particular contaminated and toxic gases, liquids and solids, in a reactor vessel with molten metal and feed tuyères below the bath surface. The effective sealing of the feed tuyères in the surrounding refractory lining by the inventive method has made it possible to avoid a backflow of these hazardous substances. For example toxic, organic liquids have been disposed of in an iron bath reactor with no problem.

The method according to the invention has also proven advantageous for installing gas feed pipes in porous plugs. These plugs are used as gas feed means in various embodiments, e.g. as gas-permeable refractory material, with fine channels, also with a plurality of thin metal pipes, in metallurgical aggregates such as converters, ladles, reactors, mainly in order to improve the bath motion of the smelt in these vessels.

It is known to cement the gas feed pipe in the refractory material of the plugs or to weld it over gas-distributing chambers made of sheet steel or possibly to the metal casing of the plugs. Leaks frequently occur at the parting line between metal and refractory material.

The inventive method can avoid this leakage and simplifies the connection of the gas feed pipe to the plug. A metal ring or ring segment is welded onto the gas feed pipe as a supporting bearing for the packing. This is followed by the packing wound in a spiral shape from several layers of sealing tape, and then by a threaded sleeve or screw nut that engages a thread on the pipe. As soon as the pipe is introduced with the packing into the corresponding bore on the back of the plug, the screw nut is tightened and the compression of the packing holds the gas feed pipe gastight in the plug, as with a stuffing box.

In the following the inventive method and apparatus will be explained in more detail with reference to examples and pictures.

FIG. 1 shows the longitudinal section through the partial area of a double-pipe tuyère in the tuyère channel of the refractory material in which the packing acts, prestressed by a mechanical actuator.

Figure 2:
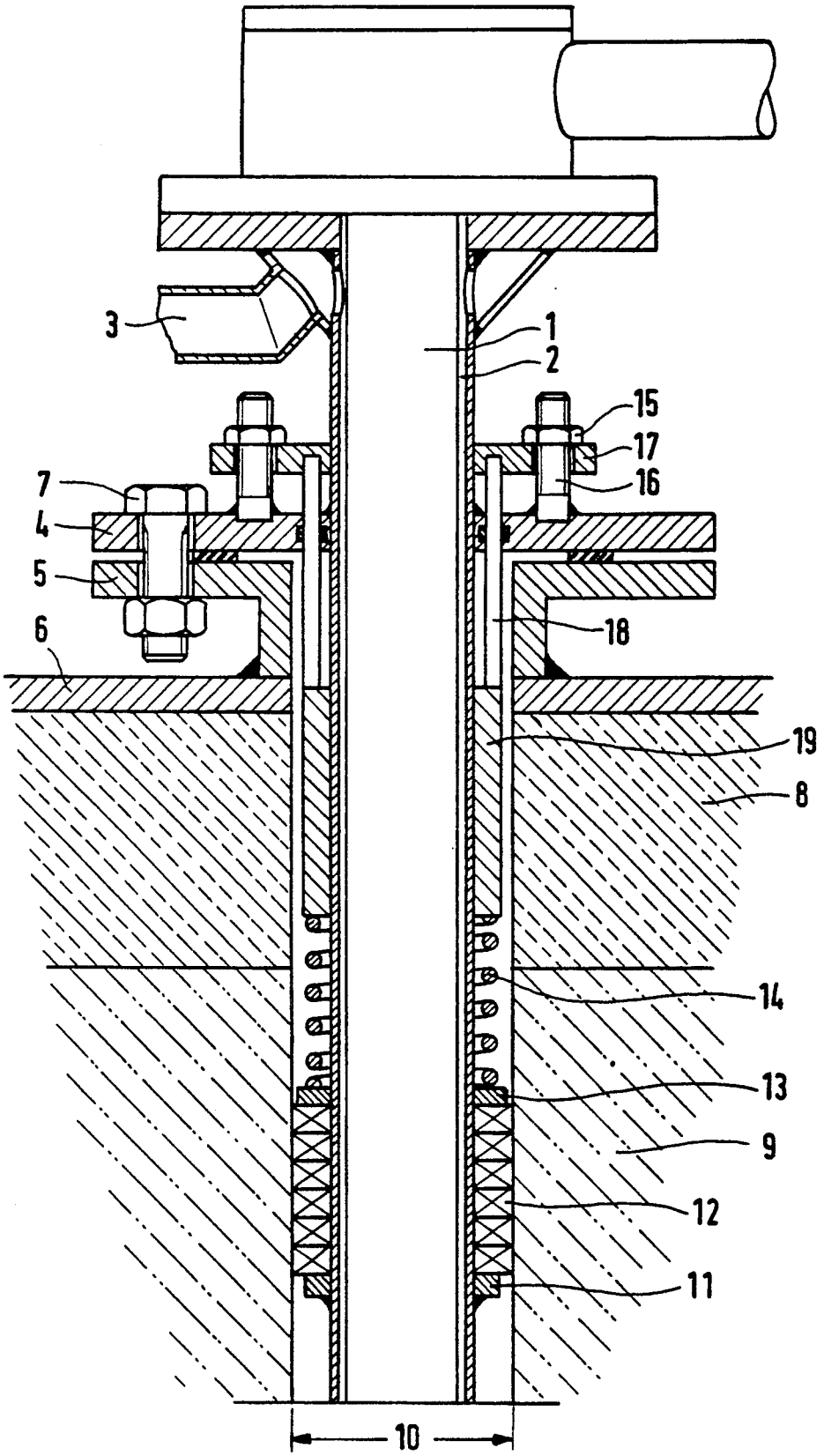

FIG. 2 likewise shows the longitudinal section through a double-pipe tuyère from the outer wall of the vessel to a depth within the refractory material at which the seal is disposed, prestressed by a spring.

According to FIG. 1 the drilled tuyère channel with diameter 1 of 56 mm is located in refractory material 10 of a steelmaking converter bottom. This tuyère channel contains a customary oxygen feed tuyère comprising two concentric pipes with outside diameters 2 of 42 mm and 3 of 35 mm, respectively. Steel ring 4 is welded onto the outer tuyère pipe as a supporting bearing for packing 5.

Packing 5 comprises six layers of a commercial graphited sealing tape wound in a spiral shape with an approximately square cross section and an edge length of about 6 mm. This commercial stuffing-box packing is made of a graphite-plastic fibrous tissue and is suitable for high application temperatures, at most about 500° C.

Threaded sleeve 7 is also welded or hard-soldered gastight onto the tuyère pipe. During assembly the tuyère is first inserted with its supporting bearing 4 and soldered-on threaded sleeve 7 together with packing 5 into annular gap 9 which is about 7 mm wide. The mechanical actuator, namely screwable threaded sleeve 6, whose thread engages the sleeve welded to the tuyère pipe, is then introduced into annular gap 9. Screw sleeve 6 has an end piece 8 which can be engaged by a tubular turn handle, which is not shown, and this wrench is used to turn the screw sleeve until it has sufficiently compressed and prestressed packing 5.

In the described and illustrated case, the screwing of sleeve 6 and thus the prestressing of packing 5 took place from the upper side of the bottom, i.e. from the tip of the tuyère. It is thus not possible to restress this packing during the operating time of the converter bottom. Instead one shakes the customary ceramic tuyère sealing compound into annular gap 9 after the packing has been prestressed.

The packing can of course also be prestressed by a corresponding sleeve from the cold side. The position of sleeve 6 shown must then be exchanged analogously with supporting ring 4. Suitable aids can then be used to restress the packing in downtimes in the converter bottom.

It is particularly advantageous according to the invention to dispose a flat spiral spring between packing 5 and sleeve 6 and to prestress it at least 2 cm. This spring then maintains a constant pressure on the packing.

FIG. 2 likewise shows a double-pipe tuyère through whose inner pipe 11 ground coal is blown into a smelting reduction reactor below the bath surface with a carrier gas, mainly nitrogen argon CO, $CO_2$, natural gas or propane. Natural gas flows through annular gap 12 for tuyère protection, reaching the annular gap via feed pipe 13. The tuyère is firmly connected with the reactor via tuyère flange 14, which is supported on corresponding flange 15 on outer wall 16 of the vessel, and fastening screws 17.

The tuyère channel with diameter 1 of 56 mm is drilled into the two-layer brickwork comprising insulating layer 18 and wearing layer 19. Supporting bearing 4 for packing 5 is firmly welded to the tuyère pipe. The pressure of prestressed flat spiral spring 21 acts on movable ring 20. Spring 21 is prestressed by screws 22 on bolts 23 through transmitting piece 24, and from there pins 25 act on spring 21 via tubular, displaceable transition piece 26.

The position of transition piece 26 can of course also be exchanged with spring 21, depending on the fitting depth and the expected temperature load. Pins 25 then act directly on the spring via an intermediate ring, similar to 20, and the force is accordingly transmitted to the packing by transition piece 26.

In the illustrated case with diameter 1 of the tuyère channel of 56 mm and the outside diameter of the tuyère pipe of 42 mm, the resulting width of the annular gap is about 7 mm and the annular gap cross section is about 11 $cm^2$. At a selected spring force of about 200 kg there is a pressure of about 19 $kg/cm^2$ on the packing. The prestressed spring excursion is about 25 mm, so that this preliminary pressure on the packing can be expected throughout the operating time.

When the inventive method is applied for sealing the oxygen feed tuyères in the bottom of a KMS converter clear advantages have resulted. The tuyères in the bottom brickwork were sealed approximately as shown and described in FIG. 2. In the KMS converter about 12,000 $Nm^3/h$ of oxygen, distributed over eight feed tuyères, flows into the refining vessel through the bottom during the refining time. To protect these tuyères from burning back prematurely natural gas normally flows in an amount of 850 $Nm^3/h$ through the annular gap between the central oxygen pipe and the outer tuyère pipe. A considerable proportion thereof is lost as vagrant gas probably for the most part through the gap between tuyère and surrounding brickwork. This manifests itself by strong flame formation at leaky places in the bottom. These disturbing flames lead in turn to an undesirable evolution of heat at the feed pipes for the tuyères. This overheating has frequently led to stoppages. When the inventive method was applied no flames were formed any longer on the bottom, and the amount of propane required for tuyère protection was reduced from 850 $Nm^3/h$ to 300 $Nm^3/h$ without any disadvantages for the tuyère wear.

The application of the inventive method in a pilot converter for smelting reduction was similarly successful. With the customary installation of underbath tuyères in this reactor, vagrant tuyère protecting gas, again natural gas, has led to unusual signs of wear on the magnesite-chromium bricks due to carbon deposits in the vessel lining. This effect was due to the reduction of the iron oxide content in the chromium-magnesite bricks. The application of the inventive method likewise effected a reduction in the amount of natural gas required for tuyère protection but it could in particular eliminate the signs of wear on the chromiummagnesite vessel lining.

It is within the scope of the invention to further develop and improve the range of application of the method, for example the arrangement of the packings. The seal is not limited to parting lines between metal and refractory material according to this method; it can also be used to seal ceramic pipes in refractory materials.

I claim:

1. A method for sealing feed systems, wherein the feed systems are formed of metal and include tuyères and feed pipes for injecting media into metallurgical reaction vessels, wherein the feed systems penetrate a vessel lining formed of a refractory material, sad method comprising the steps of:

providing sealing means of elastically or plastically deformable material;

providing at least one of pneumatic, hydraulic, and mechanical means disposed to cooperate with aid sealing means;

installing said sealing means in a gap between the feed systems and the refractory material surroundings said feed systems such that said sealing means prevents a backflow of media, wherein the sealing means is disposed upon an outer peripheral surface of the feed systems;

applying pressure directly to said sealing means with said at least one of sad pneumatic, hydraulic, and mechanical means in a direction of a longitudinal axis of the feed systems, to radially expand the sealing means to sealingly engage the feed systems and the refractory material surrounding the feed systems, wherein said pressure is applied in a constant and adjustable manner such that a position of the feed systems with respect to the refractory material remains unchanged.

2. The method of claim 1, wherein the pressure acting on the sealing means is adjusted between 10 $kg/cm^2$ and 50 $kg/cm^2$.

3. The method of claim 1, wherein the sealing means are pressurized with one of pneumatically and hydraulically driven tubular pistons surrounding the tuyère or feed pipe.

4. The method of claim 1, wherein the sealing means are pressurized with prestressed flat spiral springs.

5. The method of claim 1, wherein the pressure acting on the sealing means is held constant.

6. The method of claim 1, wherein the pressure acting on the sealing means is adjusted to vary at predetermined times.

7. The method of claim 1, characterized in that the pressure acting on the seals is adjusted evenly or alternatingly between a maximum and a minimum value.

8. The method of one or more of claims 3 to 7, wherein the pressure acting on the sealing means is adjusted between 5 $kg/cm^2$ and 500 $kg/cm^2$.

9. The method of claim 1, wherein the sealing means are disposed in the area of an outer side of the lining at most up to half of the tuyères penetrating the lining.

10. An apparatus for sealing tuyères and feed pipes for media in metallurgical reaction vessels in which feed systems are installed in a refractory vessel lining, wherein seals of elastically or plastically deformable materials are installed int he gap between the tuyère or feed pipe and surrounding refractory material during assembly of the feed systems in order to avoid backflow of media, wherein one of pneumatic, hydraulic and mechanical means are provided to hold the seals constantly under an adjustable pressure, such that the seals are compressed along a longitudinal axis, thereby radially expanding to sealing engage the tuyère or feed pipe and the refractory material.

11. The apparatus of claim 10, wherein the mechanical means have one of a pneumatically and hydraulically driven tubular piston surrounding the tuyère or feed pipe.

12. The apparatus of claim 10, wherein the mechanical means includes a flat spiral spring.

13. The apparatus of claim 10, wherein the seals are disposed in an area of an outer, side of the lining at most up to half of the tuyère penetrating the lining.

* * * * *